US005117946A

United States Patent [19]

Traktovenko et al.

[11] Patent Number: 5,117,946

[45] Date of Patent: Jun. 2, 1992

[54] ELEVATOR CAB GUIDANCE ASSEMBLY

[75] Inventors: Boris G. Traktovenko; Clement A. Skalski, both of Avon, Conn.

[73] Assignee: Otis Elevator Company, Farmington, Conn.

[21] Appl. No.: 739,631

[22] Filed: Aug. 2, 1991

[51] Int. Cl.[5] ..... B66B 7/04

[52] U.S. Cl. ..... 187/95

[58] Field of Search ..... 187/95, 131

[56] References Cited

U.S. PATENT DOCUMENTS

| | | | |
|---|---|---|---|
| 1,713,165 | 5/1929 | Bridge | 187/95 |
| 3,087,583 | 4/1963 | Bruns | 187/95 |
| 3,099,334 | 7/1963 | Tucker, Jr. | 187/95 |
| 3,669,222 | 6/1972 | Takamura et al. | 187/95 |

FOREIGN PATENT DOCUMENTS

| | | |
|---|---|---|
| 0033184 | 5/1981 | European Pat. Off. . |
| 1269789 | 6/1968 | Fed. Rep. of Germany . |
| 52-9246 | 1/1977 | Japan . |
| 3-23185 | 1/1991 | Japan . |
| 784798 | 10/1957 | United Kingdom . |
| 2238404A | 5/1991 | United Kingdom . |

*Primary Examiner*—Robert P. Olszewski
*Assistant Examiner*—Dean A. Reichard
*Attorney, Agent, or Firm*—William W. Jones

[57] ABSTRACT

An elevator cab assembly is provided with a rail guidance system which provides a substantially vibration-free ride despite uneven passenger loading. The guidance system includes side-to-side and front-to-back rail guide rollers which are adjustably mounted on the cab frame. The rail guide rollers are pivotally mounted on links which are spring-biased toward the guide rail blades. Stops are provided on the links to limit the extent of permissible pivotal movement of the rollers away from the guide rail blades. Actuators are connected to the link springs to selectively increase the spring pressure acting on the links when the pivot stops are engaged as a result of uneven passenger loading in the cab. The actuators ensure that the roller links do not ride against the stops, thereby ensuring a continuous spring biased engagement between the guide rollers and the guide rail blades, and a substantially vibration-free ride.

15 Claims, 8 Drawing Sheets

ELEVATOR CAB GUIDANCE ASSEMBLY

TECHNICAL FIELD

This invention relates to an elevator cab assembly guidance system which automatically adjusts the attitude of the cab to compensate for uneven passenger distribution within the cab. A smoother ride is thus provided for the elevator passengers. The system of this invention is preferably used in connection with an active vibration damping system disclosed in copending application U.S. Ser. No. 07/731,,185, filed July 16, 1991.

BACKGROUND ART

An elevator cab assembly will comprise a passenger cab which is mounted in a frame. The cab assembly moves up and down in the elevator hoistway along guide rails which are mounted on opposite walls of the hoistway. Guidance systems, such as rollers, guides, or the like are mounted on the cab frame and engage the guide rails to stabilize the cab assembly as it moves up and down in the hoistway. The guide rails are typically T-shaped and include a blade part which extends toward the cab frame and is engaged by the cab assembly guidance systems. When guide rollers are used as the guidance system, each guidance assembly will include three cooperating rollers arranged in a cluster wherein: an opposed pair of the rollers engages opposite sides of the guide rail blade to provide front and back stability; and a third roller engages the end face of the blade to provide side-to-side stability. There is a roller cluster mounted at each corner of the cab frame. The two upper corner roller clusters are mounted on base plates which project beyond the sides of the frame, and which have slots formed therein to receive the guide rail blades. A coverplate is also mounted over these two clusters to protect the rollers from hoistway debris. The cover plates have slots for receiving the guide rail blades. The rollers are each mounted on lever arms on their respective base plates which are spring biased so as to press the rollers resiliently against the guide rail blades. U.S. Pat. Nos. 3,087,583 to W. H. Bruns and 3,099,334 to B. W. Tucker, Jr. disclose typical prior art elevator cab assembly guidance systems of the roller cluster type described above. As disclosed in U.S. Pat. No. 3,099,334, there are adjustable stops provided on the roller pivot arms or bell cranks which limit the extent to which the rollers can pivot away from the guide rail blades so as to prevent the latter from touching the slots in the base plate, and also in the cover plate for the upper roller clusters. These prior art roller guide systems provide an acceptable quality ride so long as the cab is relatively evenly loaded with passengers, i.e., so long as the cumulative weight of the passengers is evenly distributed in the cab. So long as there is even passenger loading, the roller lever arms will not be pivoted to the extent necessary to ride on the stops for any length of time. In the event, however, that the cab becomes unevenly loaded, as is often the case, the cab assembly's center of gravity will shift, and the cab assembly will tend to tilt or cant to one side, or backward or forward in the hoistway. The reason this occurs is because the cab is suspended in the hoistway on cables which are generally disposed close to an imaginary vertical line which passes through the center of gravity of the cab assembly when empty of passengers. When the cab assembly is unevenly loaded, the side thrust forces imposed on the guide rollers will not be equal, whereby some of the rollers will be subjected to abnormally high forces by the guide rails. These high forces can cause the roller pivot links to pivot against the spring bias to such an extent that the links will be grounded on the pivot stops for an extended period of time, i.e. so long as the load in the cab remains unevenly distributed. When this happens, vibrations from the guide rails and other sources are transmitted to the cab and passengers, and are not damped out by the link springs on the grounded guide roller links. The result is a lower quality bumpy ride in the elevator. The softer the springs, the better the ride, but more fly time is spent riding against the stoppers; hence, there is a tradeoff.

Japanese Kokai Publication No. 3-23185, published January 31, 1991, discloses a system for stabilizing an elevator cab as it is moving along guide rails in a hoistway, which guide rails possess a varying compliancy. The system includes transverse beams above and below the cab assembly which are adjustably movable relative to the cab assembly. Rail guides are mounted on the ends of the transverse beams by means of vibration-proof rubber pads. The beams are also connected to the cab assembly by vibration-proof rubber pads. A contoured guide piece is fixed to the hoistway wall which mimics the compliancy values of the rails, and contact sensors are mounted on the beams to slide over the guide piece. Motion of the contact sensors is monitored by a control which operates actuators operable to laterally shift the beams in response to movement of the contact sensors. The rail guide will thus be moved laterally relative to the cab assembly as the rail compliancy varies. A problem found in this Japanese teaching concerns the fact that if the beam is moved to the left to shift the left-hand rail guides in response to variations in compliancy of the left-hand rail, then the right-hand rail guides must necessarily move in the same direction as the left-hand rail guides. The objective of moving the rail guides toward a rail as rail compliancy increases, and away from the rail as rail compliancy decreases is thus only attainable on one of the rails, and the opposite rail guide movement occurs at the other opposite side rail. The use of the guide piece is also cumbersome, and its ability to mirror rail compliancy is problematic, at best.

DISCLOSURE OF THE INVENTION

This invention relates to a guidance assembly for an elevator which is automatically adjustable in response to conditions, such as uneven passenger loading, which impose intensified guide rail thrust forces on one or more of the guide rollers. Hence softer springs can be used and better ride quality can be achieved. The guide rollers are mounted on pivotable links which are spring biased so as to urge the rollers against the guide rail blade with a predetermined thrust force. Pivot stops are associated with the links so as to limit the extent of possible pivotal movement of the links, and therefore also the guide rollers in a direction away from the guide rails. Position sensors are also associated with the links so that the pivotal position of each link relative to its respective pivot stop can be ascertained. Automatic link position adjusters are operably connected to the position sensors so that the pivotal position of each link can be automatically adjusted to keep the links away from the pivot stops whenever a position sensor detects an undesirably small spacing between the link and its associated pivot stop thereby maintaining the gap between the frame and the rail. This will limit prolonged contact between the links and their associated pivot stops during operation of the elevator.

When the elevator cab is unevenly loaded with passengers sufficiently to cause an uneven thrusting of the guide rails against certain of the guide rollers, the links carrying those higher loaded guide rollers will be pivoted toward their respective pivot stops. If the links come within a predetermined distance of their pivot stops, the sensors will detect a predicted close proximity condition, and will cause the adjusters to move the affected links through the spring away from their pivot stops. This movement will thrust the affected guide rollers back against the guide rails so that the orientation of the cab in the hoistway will be returned toward its natural unloaded position. When the cab is then moved up and down in the hoistway, there is little or no likelihood that the links will be thrust into prolonged contact with their stops, and vibrations from the rails can therefore be readily dampeo by the guide roller link springs. The assembly of this invention can be used to correct side-to-side, or front-to-back uneven passenger distribution and loading in the elevator cab.

It is therefore an object of this invention to provide an elevator cab guidance system which results in consistently smoother cab ride qualities.

It is a further object of this invention to provide an elevator cab guidance system of the character described which corrects cab position in the hoistway to compensate for uneven passenger loading in the cab.

It is an additional object of this invention to provide an elevator cab guidance system of the character described utilizing guide rollers and which ensures continuous vibration damping of all of the guide rollers in the guidance system.

These and other objects and advantages of this invention will become more readily apparent from the following detailed description of a preferred embodiment thereof when taken in conjunction with the accompanying drawings, in which:

BEST MODE FOR CARRYING OUT THE INVENTION

Figure 1:
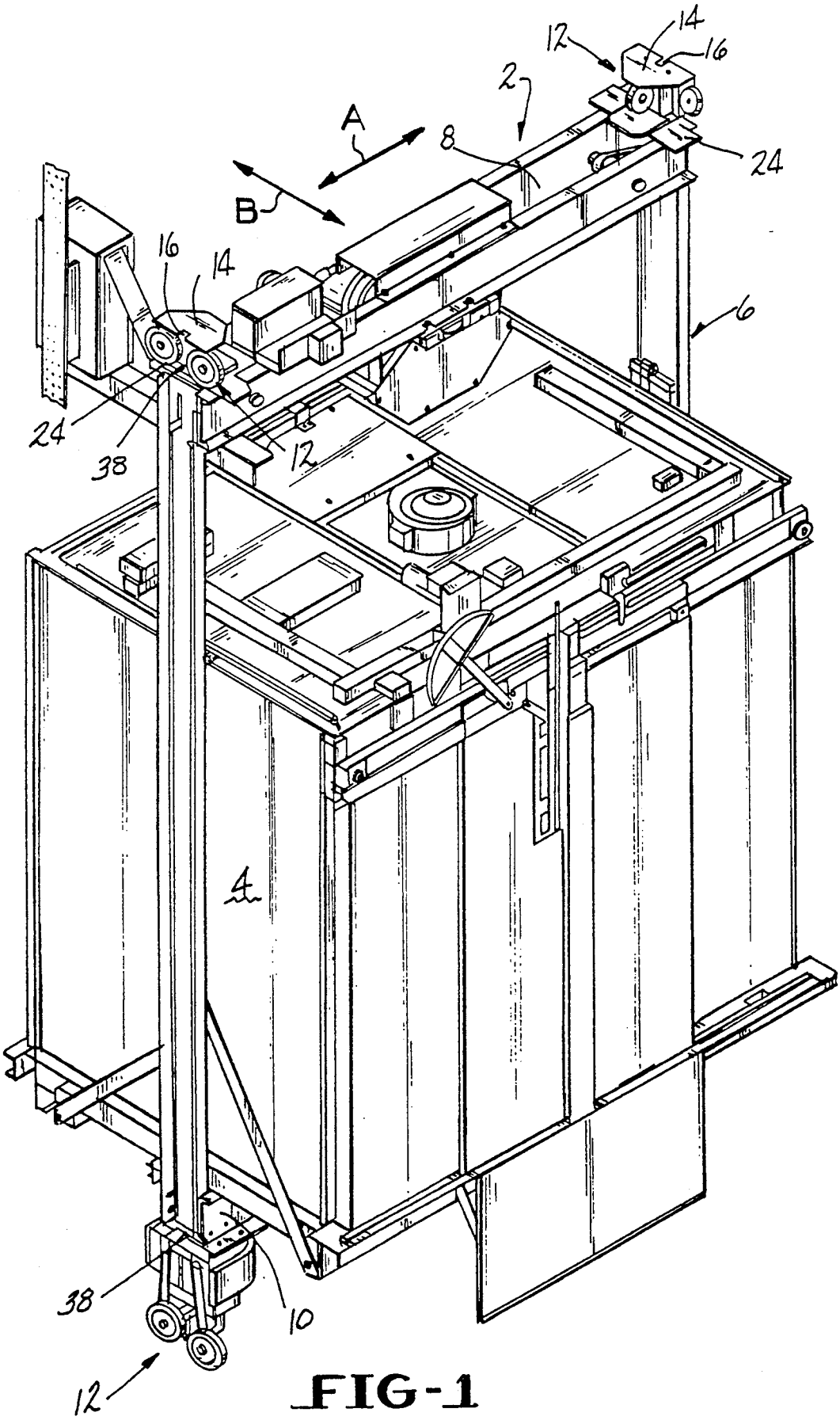
FIG. 1 is a perspective view of an elevator cab assembly with which the guidance system of this invention may be used.

Referring to FIG. 1, there is shown an elevator cab assembly denoted generally by the numeral 2 with which the guidance system of this invention can be used. The cab assembly 2 includes a passenger cab 4 mounted in a frame 6. The frame 6 includes an upper crosshead 8 and a lower safety plank 10. Guide roller clusters 12 are mounted on the frame 6 at each corner thereof. The upper guide roller clusters 12 are covered by a protection plate 14 which prevents hoistway debris from impinging on the rollers. Each plate 14 includes a slot 16 through which the cab guide rail blades project to allow the rollers to engage the guide rail blades. It will be understood that, as used in this disclosure, the phrase "side-to-side" indicates the direction of the arrow A; and "front-to-back" indicates the direction of the arrow B, as shown in FIG. 1.

Figure 2:
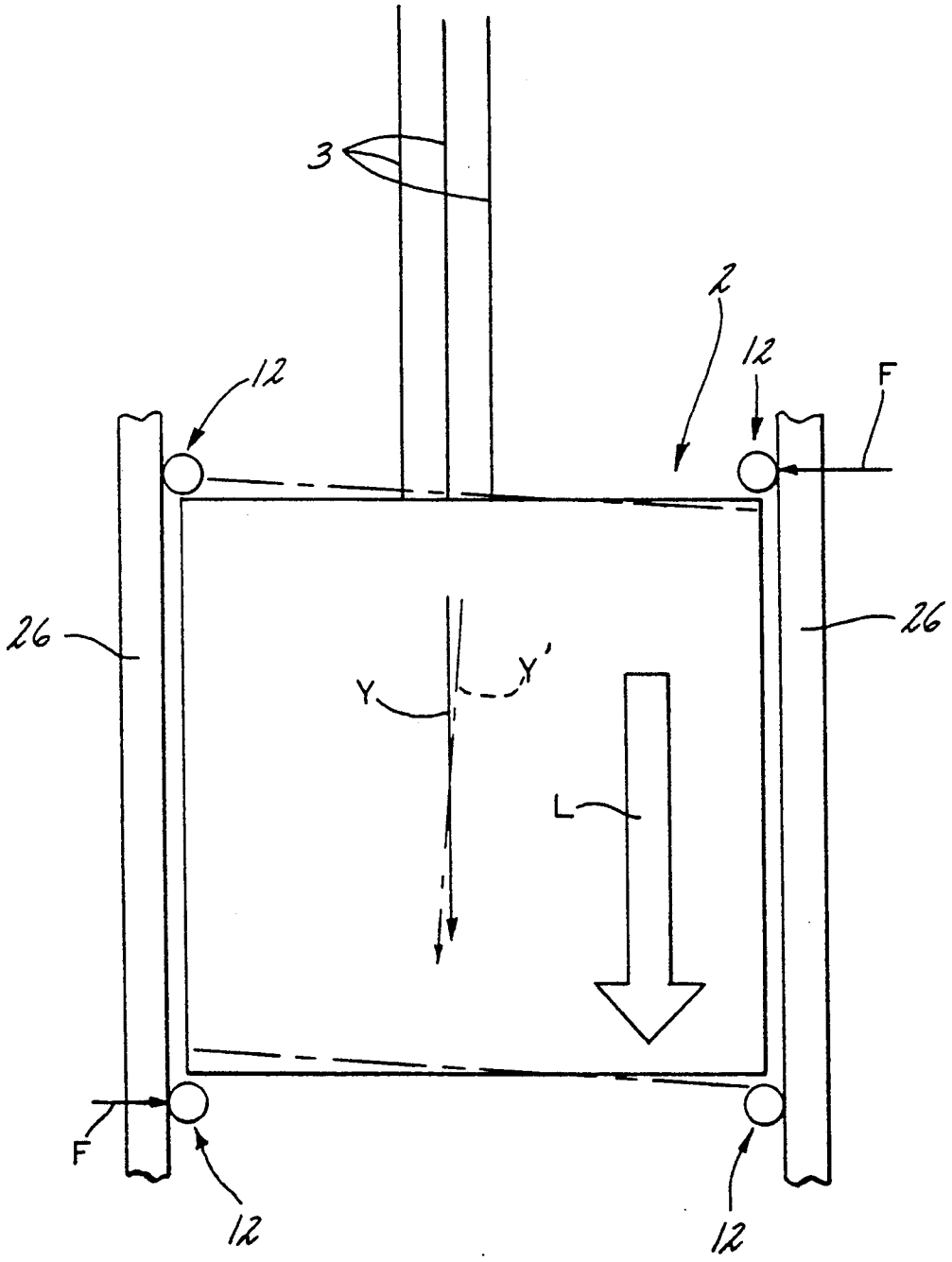
FIG. 2 is a schematic representation of how an elevator cab will become skewed or canted by uneven passenger loading.

Referring to FIG. 2, there is illustrated in schematic fashion the manner in which an elevator cab assembly 2 will become skewed in the hoistway by uneven passenger (or other) loading. The cab assembly 2 is suspended in the hoistway on cables 3, and is guided upwardly and downwardly over guide rails 26 by the guide roller clusters 12. When the cab assembly 2 is empty, or is carrying a relatively evenly distributed load, its vertical axis of symmetry will lie along line Y. If the cab is unevenly loaded, as denoted by the arrow L, the assembly 2 will cant or tilt so that the vertical axis of symmetry will skew to the position Y' shown in phantom. When this happens, the diametrically opposed guide rollers 12 at the upper right and lower left corners of the assembly 2 will encounter greater thrust forces from the rails 26, as denoted by the arrows F. The guidance assembly of this invention is capable of automatically realigning the cab assembly 2 when such a condition exists to swing the vertical axis of symmetry Y back toward its natural position. The adjustment will be made for both side-to-side and front-to-back tilting of the assembly 2.

Figure 3:
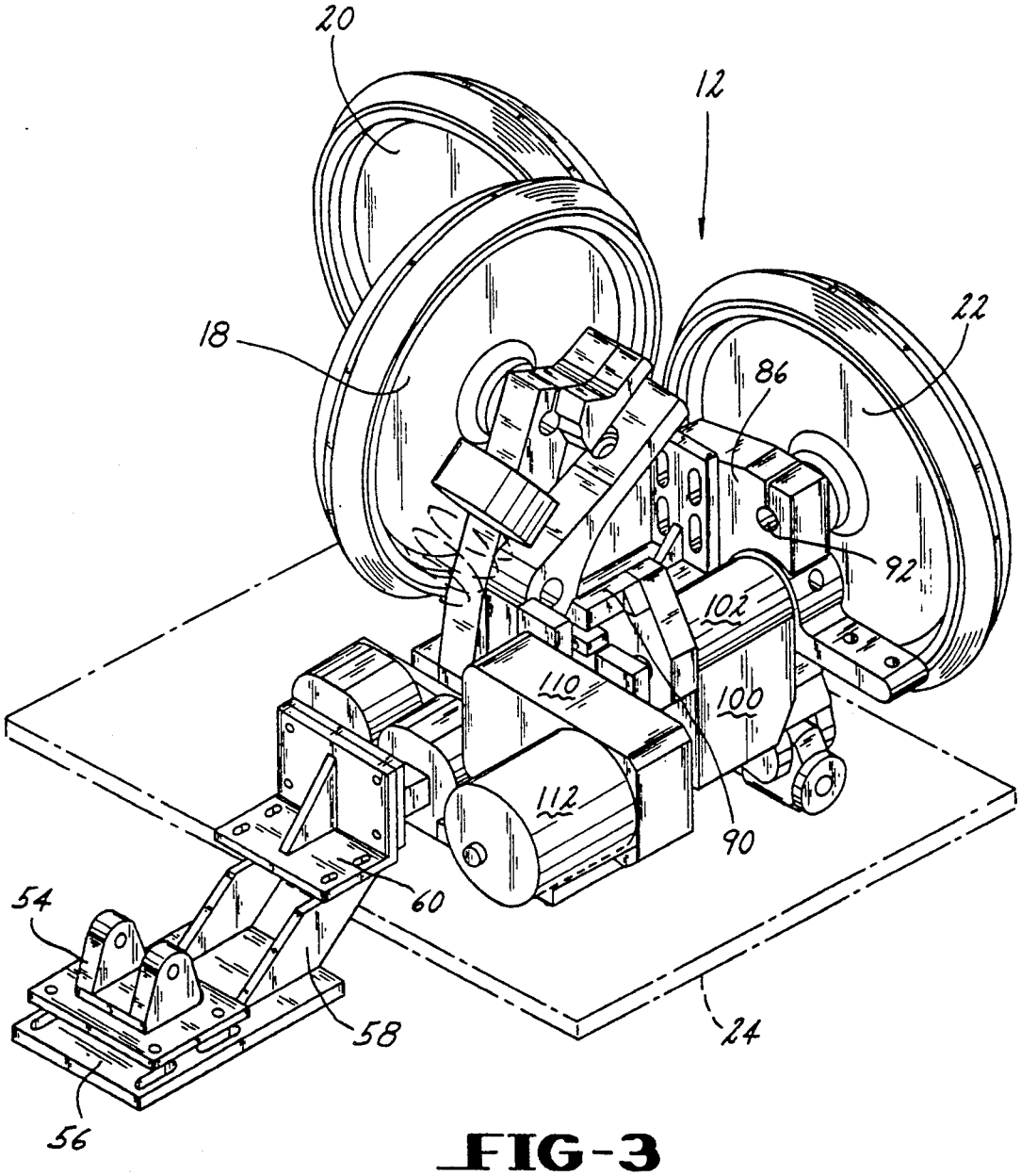
FIG. 3 is a perspective view of a guide roller cluster which is adapted for use in this invention.
Figure 4:
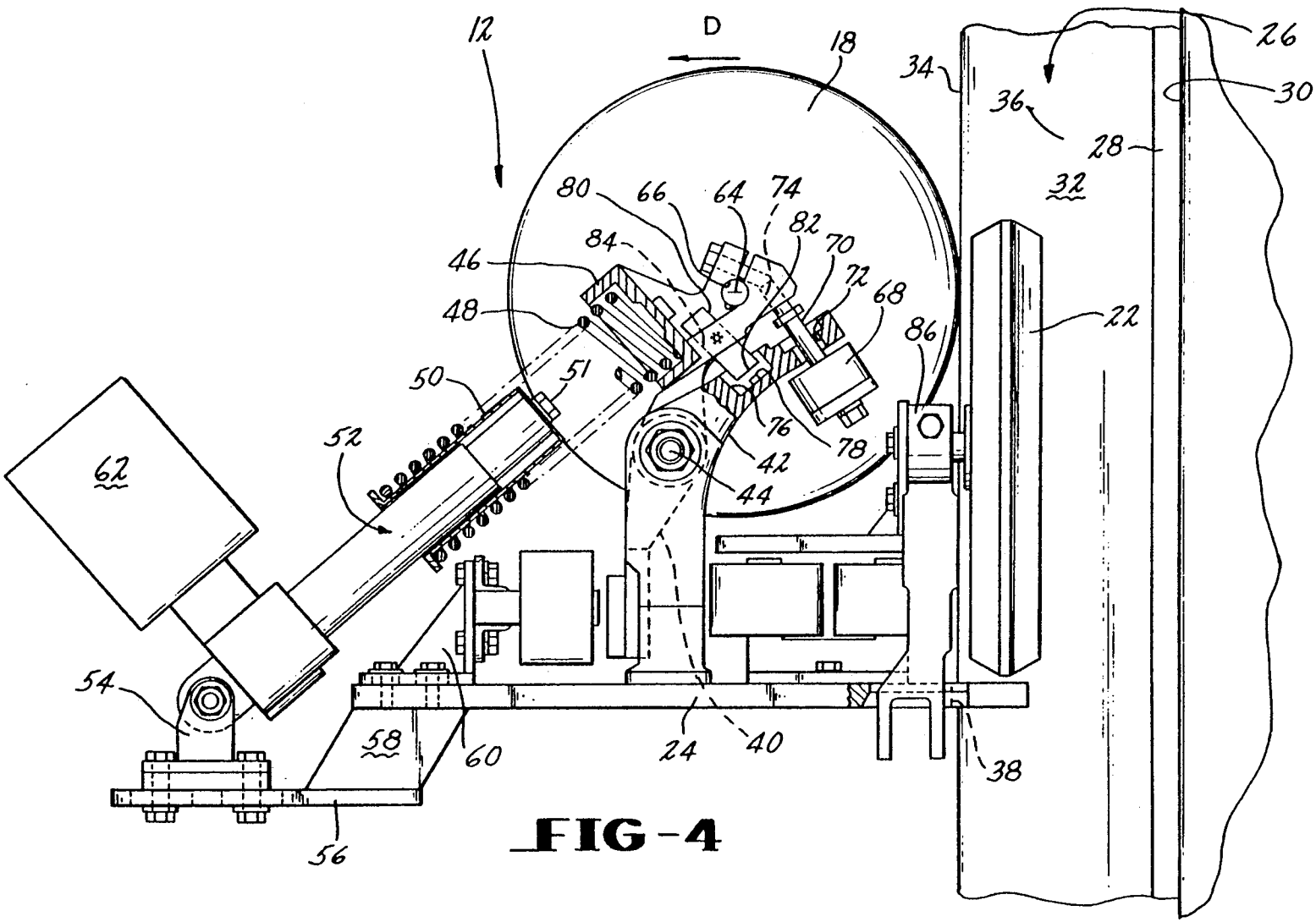
FIG. 4 is a side elevational view of the guide roller cluster of FIG. 3 showing details of the side-to-side roller adjustment mechanism.

Referring to FIGS. 3 and 4, details of one of the guide roller clusters 12 are shown. It will be appreciated that the cluster 12 is a relatively conventional assembly which has been modified to operate in accordance with this invention. The cluster 12 includes a side-to-side guide roller 18 and front-to-back guide rollers 20 and 22. The roller cluster 12 is mounted on a base plate 24 which is fixed to the frame crosshead 8. The guide rail 26 is a conventional generally T-shaped structure having basal flanges 28 for securement to the hoistway walls 30, and a blade 32 which projects into the hoistway toward the rollers 18, 20 and 22. The blade 32 has an inner face 34 which is engaged by the side-to-side roller 18, and side faces 36 which are engaged by the front-to-back rollers 20 and 22. The guide rail blade 32 extends through a slot 38 in the roller cluster base plate 24 so that the rollers 18, 20 and 22 can engage the blade 32.

As shown most clearly in FIG. 4, the side-to-side roller 18 is journaled on a link 40 which is pivotally mounted on a pedestal 42 via a pivot pin 44. The pedestal 42 is secured to the base plate 24. The link 40 includes a cup 46 which receives one end of a coil spring 48. The other end of the spring 48 is engaged by a spring guide 50 which is connected to the end of a telescoping ball screw adjustment device 52 by a bolt 51 so as to connect the adjuster 52 to the link 40 through the spring 48. The adjuster 52 can be extended or retracted to vary the force exerted on the link 40, and thus on the roller 18, by the spring 48. The ball screw device 52 is mounted on a clevis 54 bolted to a platform 56 which in turn is secured to the base plate 24 by bracket 58. The ball screw device 52 is powered by an electric motor 62. A ball screw actuator suitable for use in connection with this invention can be obtained from Motion Systems Corporation of Shrewsbury, New Jersey. The actuator motor 62 can be an AC or a DC motor, both of which are available from Motion Systems Corporation. The Motion Systems Model 85151/85152 actuator has been found to be particularly suitable for use in this invention.

The guide roller 18 is journaled on an axle 64 which is mounted in a receptor 66 in the upper end of the link 40. A pivot stop 68 is mounted on a threaded rod 70 which extends through a passage 72 in the upper end of the pedestal 42. The rod 70 is screwed into a bore 74 in the link 40. The stop 68 is operable by selective engagement with the pedestal 42 to limit the extent of movement of the link 40 in the counter-clockwise direction about the pin 44, and therefore limit the extent of movement of the roller 18 in a direction away from the rail 26, which direction is indicated by the arrow D. The pedestal 42 is formed with a well 76 containing a magnetic button 78 which contains a rare earth compound. Samarium cobalt is a rare earth compound preferred for use in the magnetic button 78. A steel tube 80, which contains a Hall effect detector proximate its end 82, is mounted in a passage 84 which extends through the link 40. The magnetic button 78 and the Hall effect detector form a proximity sensor which is operably connected to control power to the electric motor 62. The proximity sensor detects the spacing between the magnetic button 78 and the steel tube 80, which distance mirrors the distance between the pivot stop 68 and the pedestal 42 thereby maintaining a proper car-rail gap. Thus as the tube 80 and its Hall effect detector move away from the magnet 78, the pivot stop 68 moves toward the pedestal 42. The detector produces a signal when a predetermined gap between the detector and the magnetic button 78 is sensed, which signal activates the electric motor 62 whereby the ball screw 52 jack is caused to press against the spring and thus move the link 40 and roller 18 toward the rail 26. The stop 68 is thus prevented from establishing prolonged contact with the pedestal 42. This ensures that roller 18 will continue to be suspended by the spring 48 and will not be grounded to the base plate 24 by the stop 68 and pedestal 42. Side-to-side canting of the cab 4 by asymmetrical passenger loading is also corrected. The electric motors 62 can be reversible motors whereby adjustments on each side of the cab can be coordinated in both directions, both toward and away from the rails.

Figure 6:
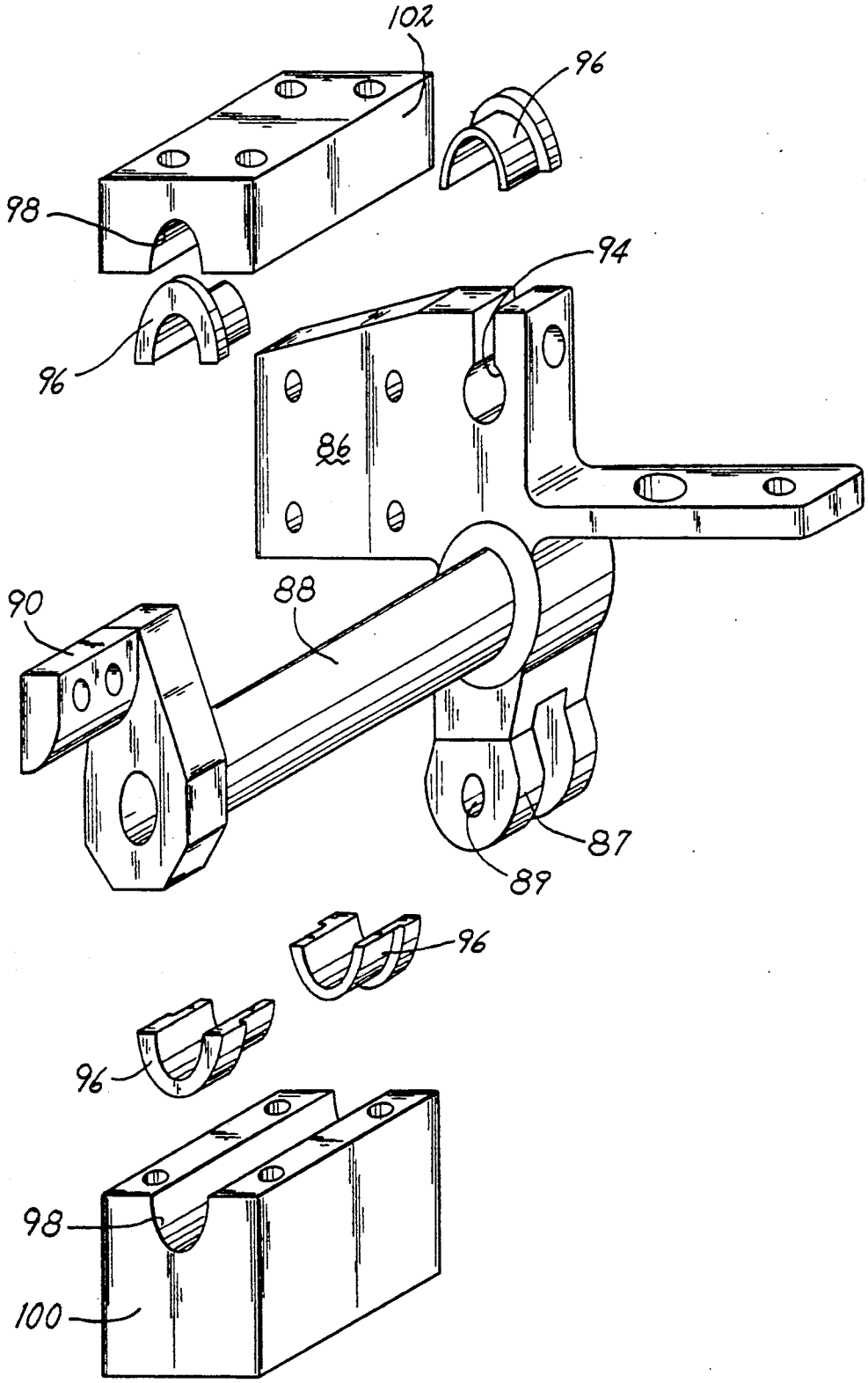
FIG. 6 is an exploded view of the front-to-back roller adjustment crank to which the spring of FIG. 4 is connected.
Figure 5:
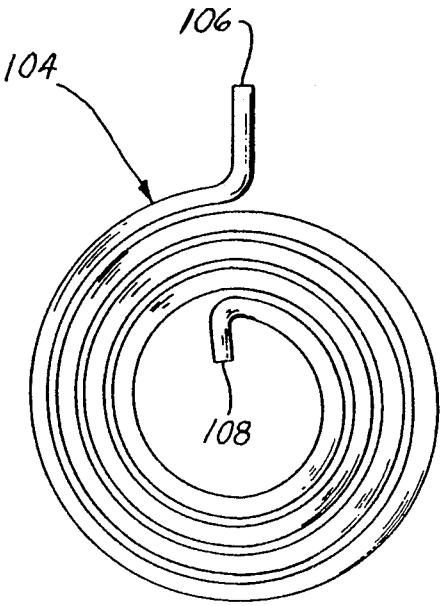
FIG. 5 is a plan view of the flat spiral spring used for biasing and adjusting the front and back rollers in the cluster.

Referring now to FIGS. 3, 5 and 6, the mounting of the front and back rollers 20 and 22 on the base plate 24 will be clarified. Each roller 20 and 22 is mounted on a link 86 connected to a pivot pin 88 which carries a crank arm 90 on the end thereof remote from the roller 20, 22. The axle 92 of the rollers 20, 22 are mounted in recesses 94 in the links 86. The pivot pin 88 is mounted in split bushings 96 which are seated in grooves 98 formed in a base block 100 and a cover plate 102 which are bolted together on the base plate 24. A flat spiral spring 104 (see FIG. 5) has its outer end 106 connected to the crank arm 90, and its inner end 108 connected to a rotatable collar which is rotated by a gear train mounted in a gear box 110, which gear train is rotated in either direction by a reversible electric motor 112. The spiral spring 104 is the bias control spring for the roller 22, and provides the spring bias force which urges the roller 22 against the rail blade 32. The spiral spring 104, when rotated by the electric motor 112 also provides the recovery impetus to the roller 22 through crank arm 90 and pivot pin 88 to offset cab tilt in the front-to-back directions caused by front-to-back asymmetrical passenger loading of the cab 4.

Figure 7:
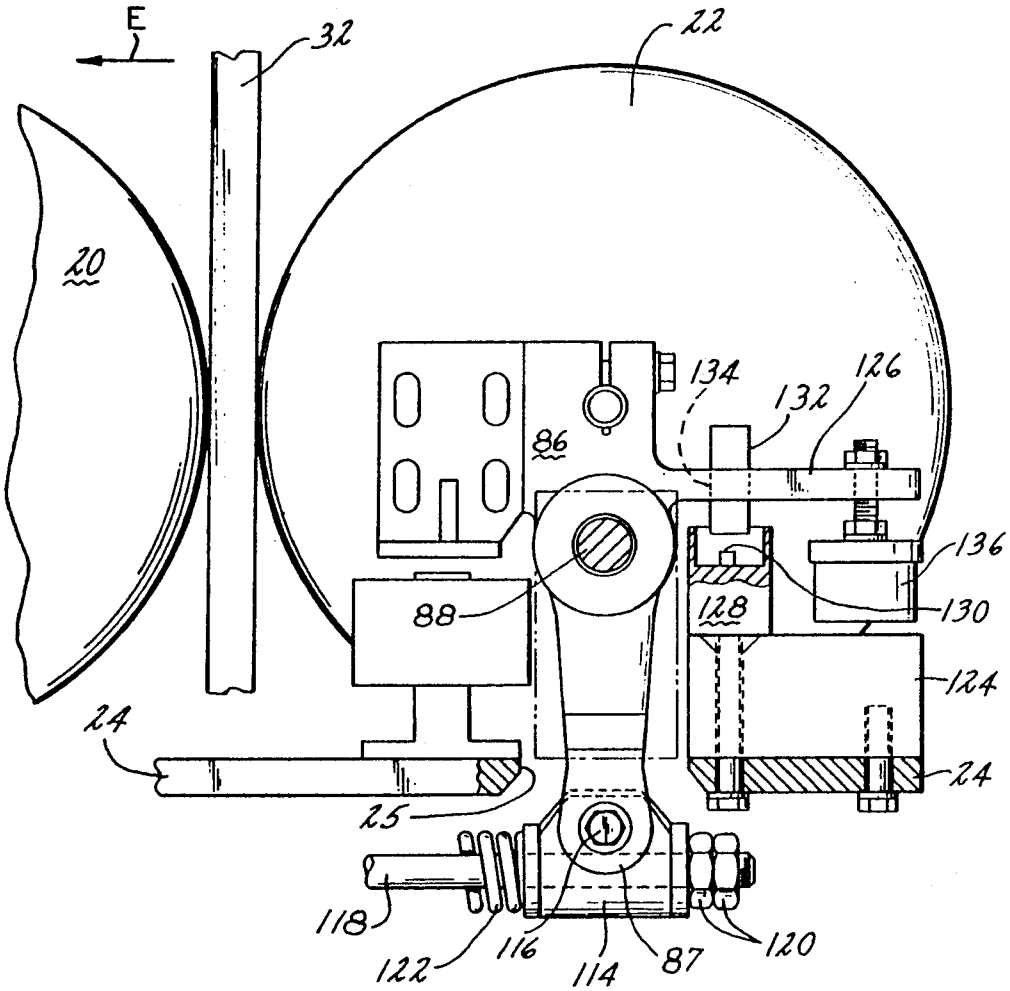
FIG. 7 is a front elevational view of the front and back guide rollers of the cluster.

Each roller 20 and 22 can be independently controlled by respective electric motors and spiral springs if desired, or they can be interconnected and controlled by only one motor/spring set, as shown in FIG. 3. Details of an operable interconnection for the rollers 20 and 22 are shown in FIG. 7. It will be noted in FIG. 6 that the links 86 have a downwardly extending clevis 87 with bolt holes 89 formed therein. The link clevis 87 extends downwardly through a gap 25 in the mounting plate 24. A collar 114 is connected to the clevis 87 by a bolt 116. A connecting rod 118 is telescoped through the collar 114, and secured thereto by a pair of nuts 120 screwed onto threaded end parts of the rod 118. A coil spring 122 is mounted on the rod 118 to bias the collar 114, and thus the link 86 in a counter-clockwise direction about the pivot pin 88, as seen in FIG. 7. It will be understood that the opposite roller 20 has an identical link, and collar assembly connected to the other end of the rod 118 and biased by the spring in the clockwise direction. It will be appreciated that movement of the link 86 in clockwise direction caused by the electric motor 112 will also result in movement of the opposite link in a clockwise direction due to the connecting rod 118. At the same time, the spring 122 will allow both links to pivot in opposite directions if necessary due to discontinuities on the rail blade 32. A flexible and soft ride thus results even with the two roller links tied together by a connecting rod.

As shown in FIG. 7, a stop and proximity sensor assembly similar to that previously described is mounted on the link 86. A block 124 is bolted to the base plate 24 below an arm 126 formed on the link 86. A cup 128 is fixed to the block 124 and contains a magnetic button 130 formed from samarium cobalt. A steel tube 132 is mounted in a passage 134 in the link arm 126, the tube 132 carrying a Hall effect detector in its lower end so as to complete the proximity sensor which monitors the position of the link 86. A pivot stop 136 is mounted on the end of the link arm 126 opposite the block 124 so as to limit the extent of possible pivotal movement of the link 86 and roller 22 away from the rail blade 32. The distance between the pivot stop 136 and block 124 is proportional to the distance between the Hall effect detector and the magnetic button 130. The Hall effect detector is operable to emit a signal to activate the electric motor 112 whenever the stop 136 comes within a preset distance from the block 124, whereupon the motor 112 will pivot the link 86 via the spiral spring 104 to move the stop 136 away from the block 124. This movement will push the roller 22 against the rail blade 32 and will, through the connecting rod 118, pull the roller 20 in the direction indicated by the arrow E, in FIG. 7. The concurrent shifting of the rollers 20 and 22 will tend to rectify any cant or tilting of the elevator cab 4 in the front-to-back direction caused by asymmetrical passenger loading.

Figure 8:
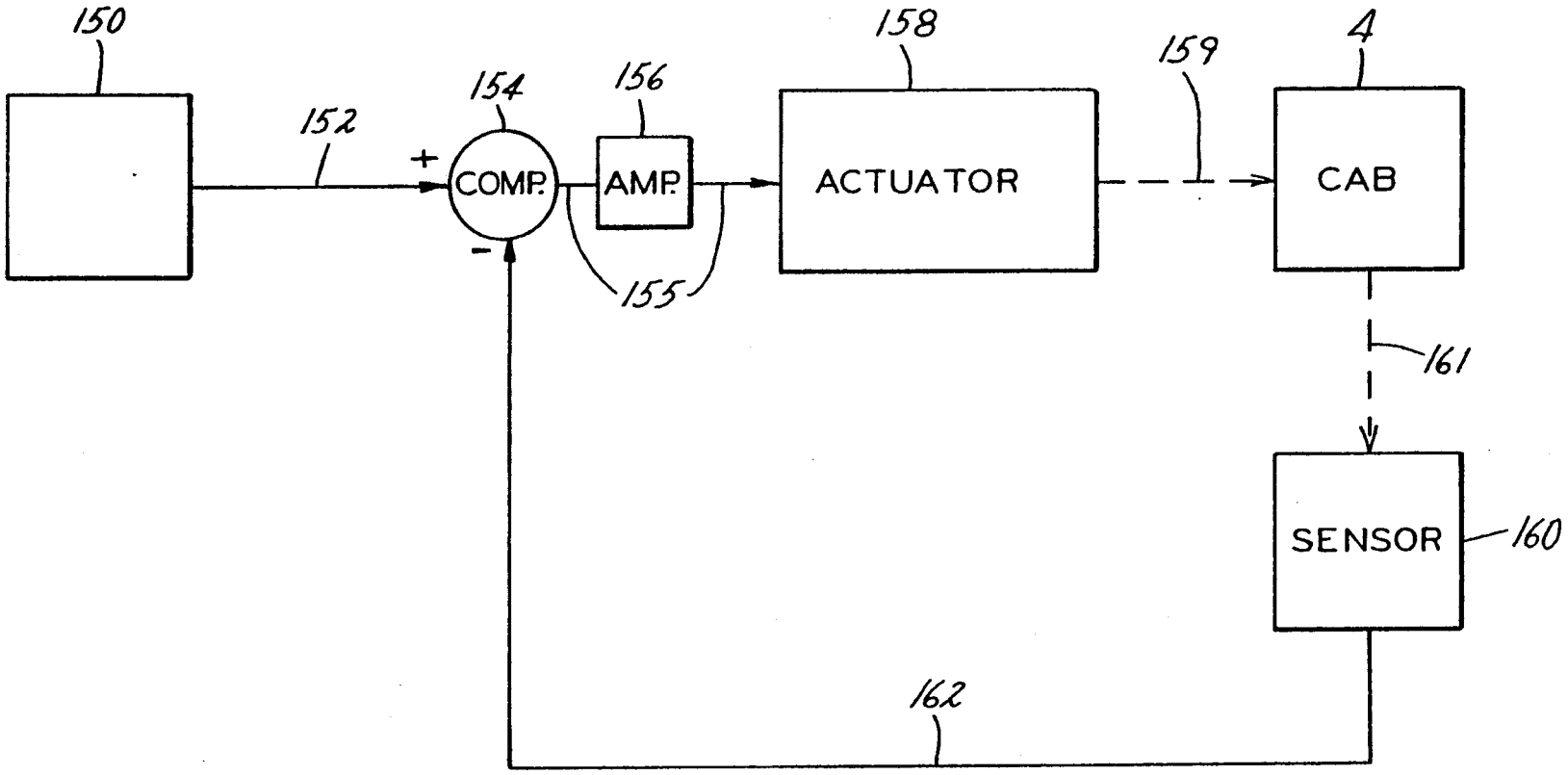
FIG. 8 is a schematic view of a control system for initiating the roller adjustments contemplated by this invention.
Figure 9:
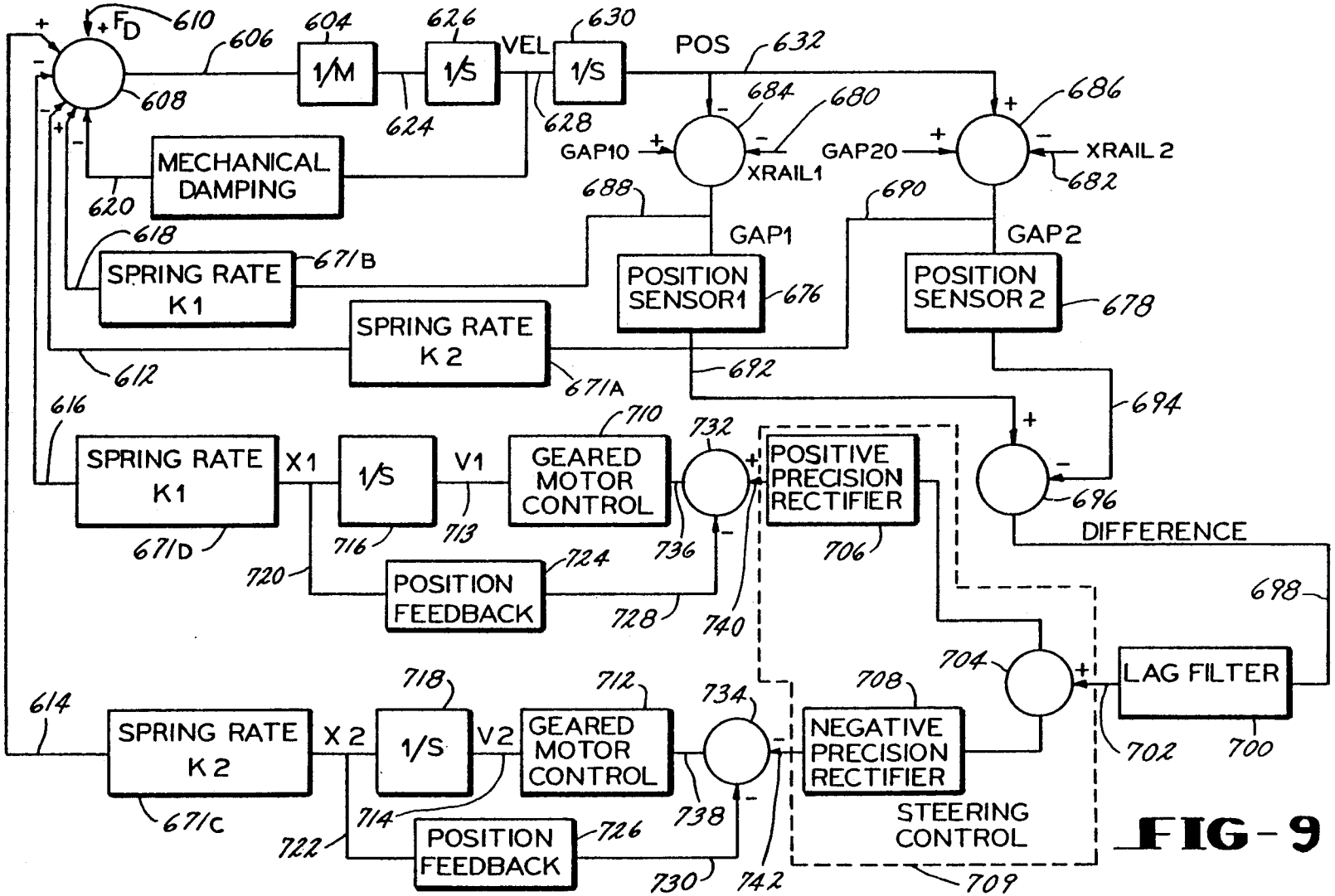
FIG. 9 is a schematic view of a control system for coordinating operation of the roller adjustment mechanisms on the cab frame.

Referring to FIG. 8, there is shown a schematic control loop for a single roller adjuster. This technique is applicable when only a single actuator is needed to perform the centering operation such as is shown in FIG. 7. If two actuators must act in concert to provide centering, then the system shown in FIG. 9 is needed. It will be understood that each adjustable roller will include a similar control loop. A reference signal 150 sends a reference gap signal through line 152 to a voltage comparator 154 which has a signal output line 155 passing through a signal amplifier 156 to the linear or rotary actuators 158. As previously described, the actuator 158 has a physical connection 159 to the cab 4, which as previously described has a physical connection to the gap sensor 160, which comprises the magnetic button and Hall effect detector described above. The sensor 160 emits a signal on line 162 to the comparator 154, which signal is proportional, or inversely proportional, as the case may be, to the gap between the Hall effect detector and the magnetic button which form a linear gap detector. The comparator compares the signals on lines 152 and 162 to determine whether the sensor signal 162 approximates, within a preset range, the reference gap signal 152, thereby indicating that the actual sensor gap is within the desired range. When an undesirable variation between the signals 152 and 162 is noted, the comparator 154 signals the actuator 158 to energize the latter and make the required gap adjustment to bring the gap back into the desired range. In this manner the spatial position of the elevator cab is periodically adjusted whenever undesirable canting of the cab is sensed as a result of asymmetrical passenger loading.

It will be readily appreciated that the guidance system of this invention will provide an improved quality ride for the passengers in the elevator cab by ensuring that the guide rollers maintain proper orientation relative to the guide rails and to the pivot stops. This ensures that the spring dampers on each roller assembly will remain operative despite asymmetric passenger distribution, or load distribution in the cab. By periodically and automatically adjusting the position of the guide rollers on the cab frame to counteract changes in guide rail pressure resulting from canting of the cab, the likelihood of prolonged contact between the guide roller pivot stops and the cab frame is eliminated thereby insuring continued spring damping of the guide rollers. The system is compact and adjustable thereby allowing older cab assemblies to be retrofitted with the guide roller assembly of this invention.

Turning now to FIG. 9, a system-level diagram is presented to show a control scheme for a pair of opposed guide roller clusters 12 such as are shown in FIGS. 1 and 2. The diagram includes position feedback for the screw actuators 52. It should be understood that the system of FIG. 9 is also applicable to independently controlled opposed front-to-back guide rollers 20, 22 and for those mechanically linked as shown in FIG. 7. The elevator car mass 604 is shown in FIG. 9 being acted on by a net force signal on line 606 from a summer 608 which is responsive to a disturbing force on a line 610 and a plurality of forces represented on lines 612, 614, 616, 618, and 620, all for summation in the summer 608. The disturbing force on line 610 may represent a plurality of disturbing forces, all represented on the one line 610. These disturbing forces may include direct car forces, rail-induced forces as previously described. The forces represented on lines 612–620 represent forces which counteract the disturbing forces represented on line 610. In any event, the net force on line 606 causes the elevator mass 604 to cant as manifested by an acceleration as shown on a line 624. The elevator system integrates the acceleration as indicated by an integrator 626 which is manifested by the car moving at a certain velocity as indicated by a line 628 which is in turn integrated by the elevator system as indicated by an integrator 630 into a position change for the elevator car mass as indicated by a line 632.

The two opposed ball screw actuators 52 at the cab floor as shown in FIG. 2 are operated as follows to partially correct the resultant canting of the elevator. The pair of elevator hoistway walls have a corresponding pair of rails attached thereto. Upon the surface of each rail a primary suspension, such as a roller 18 rolls on a surface of the corresponding rail at a distance respectively labeled XRAIL2 and XRAIL1. A spring constant K2, shown in FIG. 9 as a block 671*a*, acts between one corner roller 18 and actuator 52 while spring constant K1, shown in FIG. 9 as a block 671*b*, acts between the diagonally opposite corner roller 18 and actuator 52. The position of the actuator 52 with respect to the car 604 is indicated by a distance X2 while the distance between the car 604 and the centered position 671 is indicated by a distance POS with positive to the right and negative to the left of center. The distance between the elevator car 604 and the surface of a rail is indicated by a distance GAP2, and thus the distance between one actuator 52 and the surface of the rail is GAP2−X2. GAP20 represents the distance between one hoistway wall and the car 604 when the car is centered. Similar quantities are shown on the other side of the car.

A position sensor similar to the sensor 126 of FIG. 4 is shown as a block 676 for measuring the distance GAP1 in FIG. 9. Similarly, a position sensor 678 measures the GAP2 of the opposite side of the cab. It will be realized that the measured gaps are related to the quantities shown in FIG. 9 by the following equations:

$$GAP1 = -POS - XRAIL1 + GAP10; \text{ and}$$

$$GAP2 = POS - XRAIL2 + GAP20;$$

wherein GAP10 and GAP20 represent the distances between the car and the hoistway walls when the car is centered or uncanted. These gaps (10 and 20) are presented as signals fed into summers 684, 686 in producing the physical gaps indicated as GAP1 and GAP2 in lines 688, 690. These are useful for understanding the system.

Output signals from position sensors 676, 678 are provided on respective signal lines 692, 694 to a summer 696 which takes the difference between the magnitudes of the two signals and provides a difference (centering control) signal on a line 698 to a lag filter 700. The lag filter 700 provides a filtered centering control signal on a line 702 to a junction 704 which provides the filtered difference signal to each of a pair of precision rectifiers 706, 708. The rectifiers 706 and 708 together with the junction 704 comprise a steering control 709 for steering the filtered centering signal on the line 702 to one or the other of the rectifiers 706 or 708 at a time, i.e., not both at the same time. A pair of geared motor controls 710, 712 is shown, one of which will respond to the steered centering command signal by moving at a relatively slow velocity as indicated on a line 713 or 714 as integrated by the system by integration blocks 716 or 718 to an actuator position (X1 or X2) on a line 720 or 722 for actuating a spring rate 671*d* or 671*c* to provide the realignment force indicated by line 616 or 614. It should be realized that in this control system diagram, the spring rates 671*b* and 671*d* are associated with the same spring which is actuated by actuator 710. Similarly, spring rates 671*a* and 671*c* are associated with the same spring, in this case actuated by actuator 712. A pair of position feedback blocks 724, 726 are responsive to the actuator positions indicated by lines 720, 722 and include position sensors for providing feedback position signals on lines 728, 730 indicative of the position of the actuator with respect to the car. These position signals may be subjected to signal conditioning which may comprise providing a low gain feedback path. A pair of summers 732, 734 are responsive to the feedback signals on the lines 728, 730 and the centering command signal on line 702 as steered by the steering control for providing difference signals on lines 736, 738 indicative of the difference therebetween. It should be understood that one signal of a pair of output signals on lines 740, 742 from the precision rectifiers 706, 708 will comprise the steered centering command signal on line 702 and the other will be zero. By zero we mean a command having a magnitude equal to that required to cause the actuator to return to its zero position which will be that position required to maintain at least the desired preload on the primary suspension.

It will be understood that where all of the roller sets on the cab frame are provided with the ball screw adjustors, then there will be two control systems of the type shown in FIG. 9, one system for the top roller set and another identical system for the bottom roller set. It is readily apparent that the adjustment assembly of this invention will provide a smoother quieter elevator ride, and will allow the use of softer springs in the roller guide assembly. The system can be modified to operate in an intermittent manner, or in a constant manner, depending on the requirements of the installation. Specialized roller sets can be constructed and retrofitted onto existing elevator cabs.

Since many changes and variations of the disclosed embodiment of this invention may be made without departing from the inventive concept, it is not intended to limit the invention otherwise than as required by the appended claims.

What is claimed is:

1. An elevator guidance system for guiding a cab assembly along a guide rail, said system comprising:

a) guide roller means mounted upon said cab assembly to move along said rail, said guide roller means being mounted for a given range of reciprocal motion relative to said cab and against said guide rail, said roller means moving in said range of motion as said roller means moves along said rail;

b) spring means engaging said guide roller means for exerting a spring force on said guide roller means to attenuate vibration between said cab assembly and said rail as said guide roller means moves in said range of motion to provide improved ride quality of said cab assembly; and c) adjusting means engaging an end of said spring means distal of said guide roller means for automatically adjusting said spring'means in response to the position of said guide roller means in said range of motion thereby maintaining the improved ride quality said adjusting means being operable to increase said spring force in response to roller reciprocal movement derived from increases in rail pressure exerted on said guide roller means.

2. The elevator guidance system of claim 1 wherein said adjusting means intermittently adjusts said spring means in response to said position of said guide roller means.

3. The elevator guidance system of claim 1 wherein said adjusting means comprises a telescoping actuator sandwiched between said guide roller means and said cab assembly, said actuator being operable to alter the spring force in response to bidirectional reciprocal movement of said roller means relative to said cab assembly.

4. The elevator guidance system of claim 1 wherein said guide roller means comprises clusters of three guide rollers mounted at corners of said cab assembly, each cluster including a side-to-side roller and two opposed front-to-back rollers.

5. The elevator guidance system of claim 4 wherein said spring means includes a spring operably connected to one of said front-to-back rollers to bias both of said front-to-back rollers toward said rail.

6. The elevator guidance system of claim 5 comprising a tie rod operably connecting said two front-to-back rollers together.

7. The elevator guidance system of claim 6 further comprising spring means mounted on said tie rod for biasing both of said front-to-back rollers toward opposite sides of said rail.

8. The elevator guidance system of claim 5 further comprising rotary drive means operably connected to said spring for selectively altering the spring force of said spring.

9. The elevator guidance system of claim 8 further comprising a tie rod operably connecting said two front-to-back rollers whereby both of said front-to-back rollers are influenced by said spring.

10. The elevator guidance system of claim 9 further comprising a spring mounted on said tie rod and operable to bias both of said front-to-back rollers against opposite faces of said rail.

11. An elevator cab assembly guidance system for guiding movement of a cab assembly over elevator guide rails in a hoistway, said guidance system comprising:

a) a guide assembly mounted on said cab assembly for reciprocal movement against an associated one of the guide rails, said guide assembly comprising a guide means mounted at corners of the cab assembly, with each of said guide means being mounted on respective pivot arms; and comprising spring means operable to bias said pivot arms thereby urging said guide means against the associated guide rail;

b) stop means on each of said pivot arms, said stop means being operable to limit the extent of spring-compressing movement of said pivot arms in a direction away from the associated guide rail; and c) automatic adjustment means connected to said spring means and operable to prevent extended contact between said cab assembly and said stop means during operation of the elevator by selectively increasing the force exerted by said spring means on said pivot arms.

12. The guidance system of claim 11 wherein said automatic adjustment means comprises electrically powered driver means connected to said spring means and operable to increase the spring force of said spring means in response to increases in rail forces exerted on said guide means by said rails.

13. The guidance system of claim 12 wherein said automatic adjustment means includes means operably connected to said driver means for detecting said increases in rail forces, and operable to initiate corrective action by said driver means in predetermined situations.

14. An elevator cab assembly guidance system for at least partially correcting canting of the cab assembly in a hoistway resulting from uneven loading of the cab, said guidance system comprising:

a) a pair of guide roller assemblies mounted at opposed corners of a lowermost component of the cab assembly, said guide roller assemblies being operable to contact opposed guide rails in the hoistway, each of said guide roller assemblies including guide rollers mounted for reciprocal movement within a predetermined range, against said guide rails;

b) spring means operable to bias each of said guide roller assemblies toward said guide rails to cushion said cab assembly against vibration;

c) contact stop means operable to limit the extent of movement of each of said guide roller toward said cab assembly;

d) driver means connected to each of said spring means and selectively operable to increase the spring force of said spring means in response to increases in rail pressure exerted on either of said pair of guide roller assemblies; and e) detector means operably connected to said driver means to actuate the latter when said increases in rail pressure are detected, whereby one of said guide roller assemblies will be spatially adjusted to at least partially correct canting of the cab assembly resulting from uneven cab loading.

15. The guidance system of claim 14 further comprising guide roller assembly coordination means operably interconnecting said pair of guide roller assemblies for ensuring corrective actuation of only the one of said driver means which is associated with the guide roller assembly experiencing said increases in guide rail pressure.

* * * * *